US005862553A

United States Patent [19]

Haberl et al.

[11] Patent Number: 5,862,553

[45] Date of Patent: Jan. 26, 1999

[54] DYNAMIC BALANCING METHOD FOR A WASHING MACHINE

[75] Inventors: Ingo Haberl; Mario Trangoni, both of Pordenone, Italy

[73] Assignee: Electrolux Zanussi Elettrodomestici S.p.A., Pordenone, Italy

[21] Appl. No.: 841,111

[22] Filed: Apr. 29, 1997

[30] Foreign Application Priority Data

May 30, 1996 [IT] Italy ..... PN96A0033

[51] Int. Cl.[6] ..... D06F 37/22

[52] U.S. Cl. ..... 8/159; 68/12.06; 68/12.14; 68/23.2; 68/24

[58] Field of Search ..... 8/159; 68/12.06, 68/12.14, 23.2, 24

[56] References Cited

U.S. PATENT DOCUMENTS

| | | | |
|---|---|---|---|
| 3,117,926 | 1/1964 | Starr et al. | 68/12.06 X |
| 4,513,464 | 4/1985 | Rettich et al. | 8/159 |
| 4,782,544 | 11/1988 | Nystuen et al. | 8/159 |
| 4,991,247 | 2/1991 | Castwall et al. | 68/23.2 X |
| 5,692,313 | 12/1997 | Ikeda et al. | 68/12.06 X |

*Primary Examiner*—Philip R. Coe

*Attorney, Agent, or Firm*—Pearne, Gordon, McCoy and Granger LLP

[57] ABSTRACT

A clothes washing machine is provided with an oscillating washing assembly including a rotating drum capable of being driven at various rotating speeds and provided with a plurality of annular hollow bodies secured to the drum. A plurality of moving masses are capable of freely moving within the hollow bodies. Before at least one spin-extraction phase, the drum is driven to rotate in a continuous manner at a variable, relatively low speed which is lower than the resonance frequency of the oscillating washing assembly, but is adequate to cause the washload in the drum to keep adhering against the inner peripheral surface of the drum. As soon as the moving masses succeed in distributing themselves in such a manner that their center of gravity locates itself in a position that is substantially opposite to the unbalance condition of the washload, the drum is started to rotate at the desired spin-extraction rate.

12 Claims, 8 Drawing Sheets

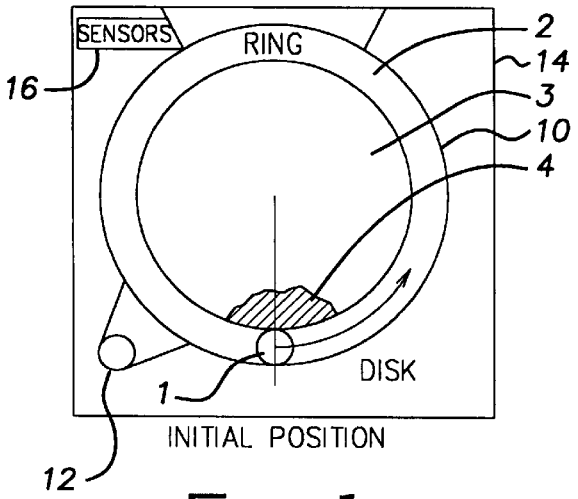
FIG. 1
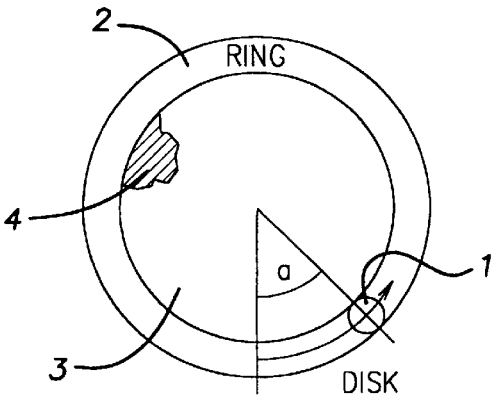
FIG. 2
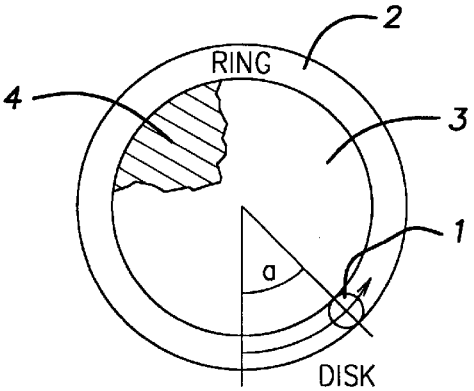
FIG. 3
FIG. 4
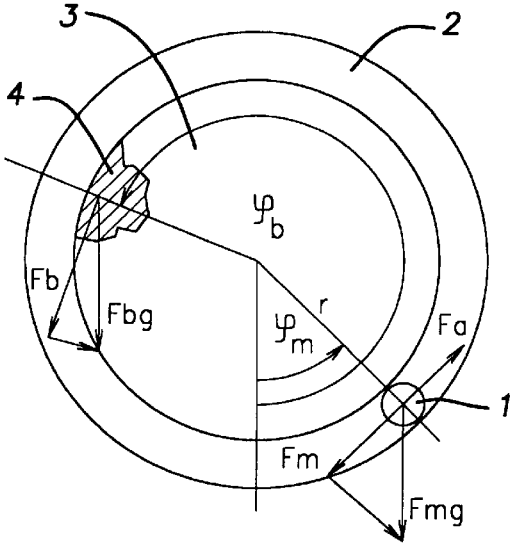

PHASE DIFFERENCE ($\varphi_b$-$\varphi_m$) VERSUS TIME BETWEEN WASHLOAD AND DISK

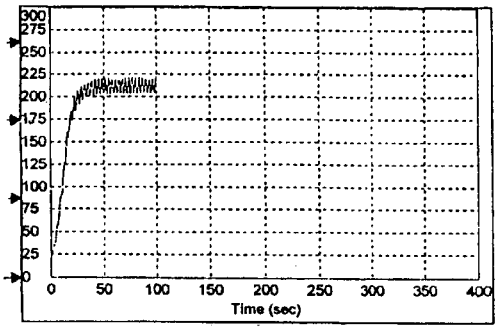

"VISCOSITY" λ=10°

FIG. 5

PHASE DIFFERENCE ($\varphi_b$-$\varphi_m$) VERSUS TIME BETWEEN WASHLOAD AND DISK

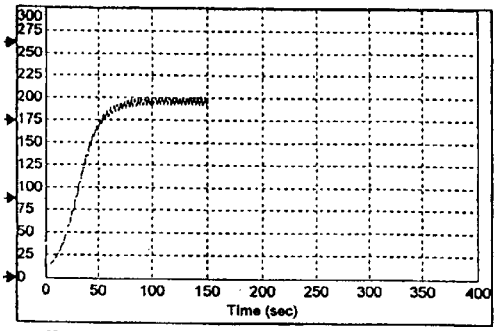

"VISCOSITY" λ=20°

FIG. 6

PHASE DIFFERENCE ($\varphi_b$-$\varphi_m$) VERSUS TIME BETWEEN WASHLOAD AND DISK

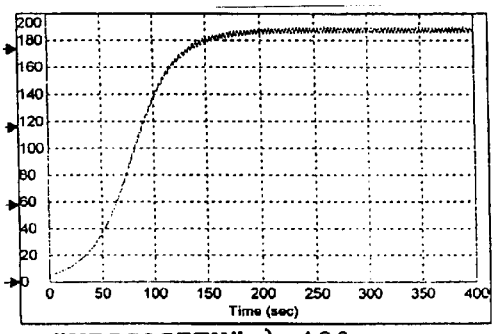

"VISCOSITY" λ=40°

FIG. 7

PHASE DIFFERENCE ($\varphi_b$-$\varphi_m$) VERSUS TIME BETWEEN WASHLOAD AND DISK

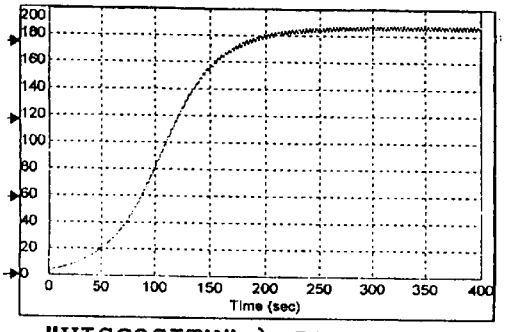

"VISCOSITY" λ=50°

FIG. 8

PHASE DIFFERENCE ($\varphi_b-\varphi_m$) VERSUS TIME BETWEEN WASHLOAD AND DISK

"VISCOSITY" λ=60°

PHASE DIFFERENCE ($\varphi_b-\varphi_m$) VERSUS TIME BETWEEN WASHLOAD AND DISK

"VISCOSITY" λ=80°

PHASE DIFFERENCE ($\varphi_b-\varphi_m$) VERSUS TIME BETWEEN WASHLOAD AND DISK

"VISCOSITY" λ=120°

DETAIL OF MOTION IN A TIME INTERVAL OF 2 SECONDS AT THE BEGINNING OF THE MOTION, IE. WHEN ($\varphi_b - \varphi_m$) ALMOST = 0°

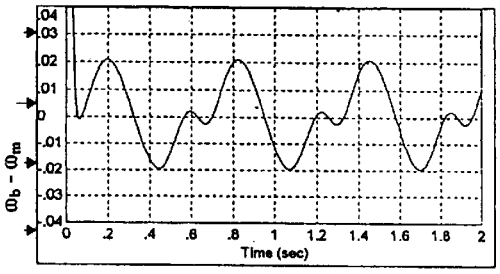

FIG. 12a

DETAIL OF MOTION IN A TIME INTERVAL OF 2 SECONDS AFTER 200 SEC. OF MOTION. IE. WHEN ($\varphi_b - \varphi_m$) ALMOST = 180°

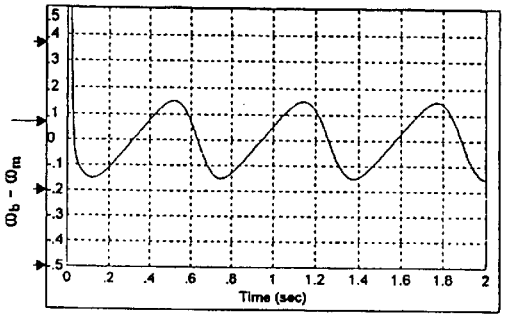

FIG. 12b

DETAIL OF MOTION IN A TIME INTERVAL OF 2 SECONDS AT THE BEGINNING OF THE MOTION, IE. WHEN ($\varphi_b - \varphi_m$) ALMOST = 0°

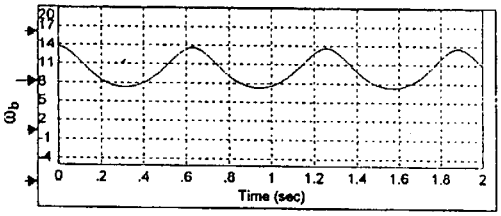

FIG. 12c

DETAIL OF MOTION IN A TIME INTERVAL OF 2 SECONDS AFTER 200 SEC. OF MOTION. IE. WHEN ($\varphi_b - \varphi_m$) ALMOST = 180°

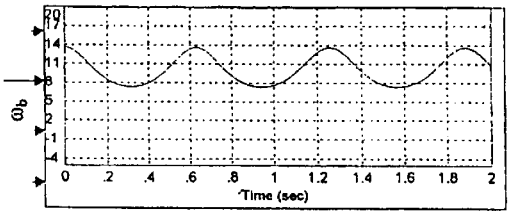

FIG. 12d

DETAIL OF MOTION IN A TIME INTERVAL OF 2 SECONDS AT THE BEGINNING OF THE MOTION, IE. WHEN ($\varphi_b - \varphi_m$) ALMOST = 0°

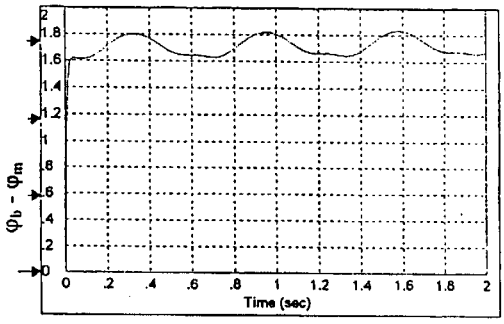

FIG. 12e

DETAIL OF MOTION IN A TIME INTERVAL OF 2 SECONDS AFTER 200 SEC. OF MOTION. IE. WHEN ($\varphi_b - \varphi_m$) ALMOST = 180°

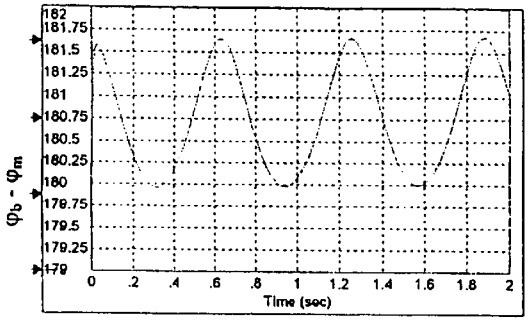

FIG. 12f

CASE WITHOUT STABILIZATION AT A PHASE SHIFT OF 180°

λ=15
k1=0.05
k2=60

CASE WITHOUT STABILIZATION AT A PHASE SHIFT OF 180°

λ=15
k1=0.05
k2=60

λ=15
k1=0.05
k2=60

DRUM ROTATION SPEED GIVEN BY THE MOTOR CHARACTERISTICS $\lambda=15$

DYNAMIC BALANCING METHOD FOR A WASHING MACHINE

DESCRIPTION

The present invention relates to a clothes washing machine, in particular of the household type, provided with an improved arrangement for dynamically balancing the drum thereof.

Although the present invention is described with particular reference to a front-loading clothes washing machine, and for reasons of greater exemplification convenience the following description refers to such a type of machine, it will be appreciated that the invention also applies advantageously to other types of clothes washing machines, such as top-loading clothes washing machines.

One of the main problems design engineers have to cope with in designing clothes washing machines, in particular those for residential use, is the balancing of the drum holding the washload during the spin-extraction phases that are carried out in order to extract rinse water quickly from the same washload. Such a problem is particularly evident when the washload in the drum is not distributed evenly, ie. is unbalanced. This causes undesired, and sometimes fully unacceptable, oscillations of the drum which then are passed on to the tub of the machine and, from the tub, to the entire outer casing. This problem is largely known in the art, so that it shall not be dealt with to any further extent.

Among the various solutions proposed in view of resolving this problem were some based on dynamic-type arrangements applying an unbalance condition of equal force, but of opposite vector, in opposition to the centrifugal force of the unbalanced washload. Such solutions are described for example in the French Patent No. 1213067 (Swiss priority 08 November 1957) as well as the Italian Patent No. 1108367 (Japanese priority 12 January 1978).

Such documents describe dynamic balancing arrangements for application to the drums of clothes washing machines, in particular of the household or residential type. The arrangements consist of annular hollow bodies associated to the drum and containing balancing masses adapted to slide within the annular hollow bodies. The masses are capable of arranging themselves in such a position as to oppose the unbalance motion of the drum brought about by an uneven distribution of the washload therein.

Such a solution, although effective, has however failed to find any practical application for a number of reasons, including in particular the following ones:

a) In presence of washloads that are quite well balanced initially, if the hollow bodies do not contain some liquid to appropriately convey or slow down the movement of the balancing masses, or have no suitable braking provision, the balancing masses tend to distribute in substantially haphazard, but mutually opposite positions along the circumference of the annular hollow bodies, so as to maintain the whole assembly in a balanced condition. However, due to the fact that the positions taken by the masses are substantially haphazard, it has been observed that, due to irregularities in their movement, tolerances in the assembly of the ring containing the masses and possible deformations thereof, vibrations occurring due to even the slightest unbalance condition give rise to an immediate re-balancing reaction by the masses which start moving around until they find a new balance position. During this "search" for a new balance position, the masses may quite easily impinge against each other, even violently, thereby giving rise to considerable noise. Once such a new balance position is found, this will not be maintained for a long time, since it just takes a new slight unbalance of the washload to cause the above described re-balancing procedure to start anew. This means that a wholly unstable condition is created in which the machine tends to get repeatedly unbalanced and re-balanced throughout its working cycle. This leads to an annoying situation since vibrations are by no means definitively suppressed in this way, while the machine keeps generating periodically substantial noise.

b) It is necessary for the drum design to undergo appropriate modifications in order to increase the overall strength of the construction and make it adapted to accommodate the installation of the hollow bodies, which tend to press against the walls of the drum with a considerable centrifugal force due to the weight of said balancing masses.

c) The annular hollow bodies that have been used so far are generally made of a rather light material which therefore tends to get distorted to a certain extent under the centrifugal force exerted by the balancing masses. The consequence of such deformations occurring in the hollow bodies is that the balancing masses are prevented from reaching an optimum position in view of being able to re-balance an unbalanced condition of the washload, with the ultimate result that said balancing effect becomes imperfect and partial.

From the patent PCT WO 93/23687 to "BALANCE TECHNOLOGY LIMITED PARTNERSHIP LA PLAIDERIE TRUST CO. LTD." a clothes washing machine is also known which is provided with a plurality of hollow bodies associated to a watertight tub rotating about an axis. The hollow bodies contain in their interior a plurality a balancing masses adapted to move in said hollow bodies, said masses being made to differing sized according to the different hollow bodies being considered.

Such a solution has attracted little interest since it has been verified that the use of moving balancing masses having different dimensions does not lead to any appreciable improvement in the balancing action. In addition, the tub in the usual residential-type clothes washing machine designs is not rotating, but stationary and the unbalance condition that needs to be corrected originates in the perforate drum and not the tub itself.

Furthermore, considerable constructional complications exist if differently and specifically sized hollow bodies and respective balancing masses are to be made and used.

In fact, the corresponding U.S. application of the above-mentioned patent has been abandoned, while a respective "continuation-in-part," U.S. Pat. No. 5,460,017, has been issued which, however, does not contain any substantial modification or improvement with respect to the original patent specification. The "continuation-in-part" cites an extensive list of the quite large number of patents that have been filed covering dynamic balancing methods.

European Patent Application No. 0 607 678 filed by Whirlpool Corporation also discloses a balancing arrangement consisting essentially of a plurality of annular hollow bodies filled with respective liquid balancing masses. In the course of in-depth, thorough experiments, however, such a solution turned out to be minimally effective in reducing unbalance situations due to the fluid nature of the balancing masses which tend to distribute along the entire circumference of the hollow bodies, thereby reducing the balancing effect.

A balancing arrangement provided with hollow bodies containing balancing masses is also known from the Italian Patent Application No. PN95A000005, filed by the Applicant hereof, wherein the hollow bodies are provided with protruding lobes which facilitate the masses in aggregating in preferred position in view of reaching the best possible balancing effect.

Such a solution, however, although being effective in facilitating the best possible arrangement of the balancing masses, has obvious, unquestionable contraindications of both technical-manufacturing and economical nature.

A balancing arrangement provided with hollow bodies containing balancing masses is further known from the Italian Patent Application No. PN94A0000052, filed by the Applicant hereof, wherein the balancing arrangement is capable of identifying the optimum conditions of the lubricant fluid, the size and number of the balancing rollers and the dimensional ratios of the rollers to the respective annular cavities in which they are rolling, as well as the distribution angle of said rollers, the number of annular cavities or hollow bodies and their geometric arrangement with respect to both each other and the drum to be balanced.

This patent specification provides a significant contribution to the feasibility of dynamic balancing arrangements that are capable of being associated to clothes washing machines to be offered on the marketplace. It identifies the optimum constructional characteristics needed to substantially improve the balancing effectiveness of such arrangements. However, the obtainable improvement is limited to the dynamic self-balancing action during the spin-extraction phase only, ie. when the drum rotates at a frequency which is considerably higher than the natural resonance frequency of the suspended washing assembly filled with its normal washload, and not during the phases in which the drum rotation frequency is considerably lower, ie. at the normal washing or even slightly higher frequencies.

A practical consequence of such a limitation is that during the time from the moment at which the spin-extraction phase is started to the moment at which the drum reaches the high speed required for spin-extraction, the suspended washing assembly of the machine is still seriously unbalanced, so that it causes, during such a start-of-spinning transient, all the traditional drawbacks which those skilled in the art are well aware of. In particular, it does not eliminate the need for solid inertial masses to be mounted on the suspended washing assembly, firmly associated therewith, in order to reduce the violent oscillations that occur during the start-of-spinning transient before the afore-cited dynamic balancing arrangements are able to start their action effectively.

BRIEF SUMMARY OF THE INVENTION

It would therefore be desirable, and is a main purpose of the present invention, to improve the construction of such drums by providing them with dynamic self-balancing means that are capable of bringing about, under definite operating conditions, a self-balancing action of the washing assembly of the machine. This is achieved at different speed including when the drum rotates at a frequency that is much lower than the spin-extraction rotation frequency, so as to enable the drum to start rotating at increasing speed for the spin-extraction phase without giving rise to the well-known drawbacks during the related transient. Therefore, there is no need for counterweight masses to be provided as usual in order to dampen the vibrations induced during said start-of-spinning operational phase.

This and further aims that will be more closely described further on in this description are reached in a clothes washing machine provided with a suspended washing assembly comprising a drum adapted to rotate at various speeds and provided with a plurality of annular hollow bodies. The hollow bodies contain a viscous liquid in their interiors and are mounted in a firm association with said drum. A plurality of moving masses are capable of freely sliding within said annular hollow bodies. Before at least one spin-extraction phase, the drum is driven to start rotating in a continuous manner at a variable, relatively low speed which is lower than the resonance frequency of said suspended washing assembly. The speed is sufficient to cause the washload items in the drum to keep adhering against the inner peripheral surface of the drum due to the effect of the centrifugal force. Then, as soon as the moving masses succeed in distributing themselves so as the center of gravity is located in a position which is substantially opposite to the unbalance condition of the washload, the drum is allowed to start rotating at the desired high spin-extraction speed.

Alternatively, the drum may be started to rotate at spin-extraction speed after a pre-determined period of rotation at said relatively low speed. The period of time is pre-calculated so that when the drum is started to rotate at high spin-extraction speed, the center of gravity of said moving masses is in a position which is substantially opposite to the unbalance condition of the washload.

BRIEF DESCRIPTION OF THE SEVERAL VIEWS OF THE DRAWINGS

The invention and the features thereof will be more readily and clearly understood from the appended claims and the description which is given below by way of non-limiting example with reference to the accompanying drawings, in which:

FIG. 1 is a schematical view of a configuration of a balancing mass and washload in their initial rotation position;

FIG. 2 is a view of the equivalent configuration a certain time after the beginning of low-speed rotation;

FIG. 3 is a view of the configuration when the balancing mass and the washload are in opposition of phase;

FIG. 4 is the same view as shown in FIG. 3, wherein the references used in the quantitative description of the invention are indicated in greater detail;

FIGS. 5 to 11 illustrate empirical examples of the angular phase displacements between the unbalanced washload and a balancing mass, or disk, versus various viscosity values and the time elapsed from the beginning of the rotation;

FIGS. 12*a* to 12*f* illustrate in detail the two relative movements of the balancing mass and the washload;

DESCRIPTION OF THE INVENTION

Figure 9:
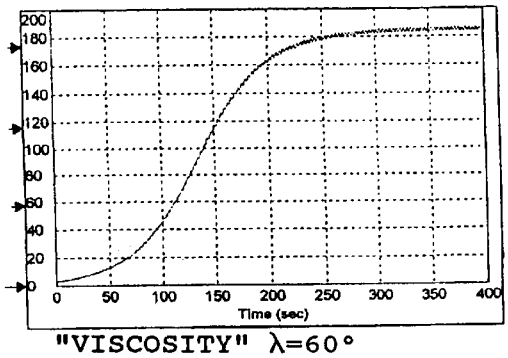
Figure 10:
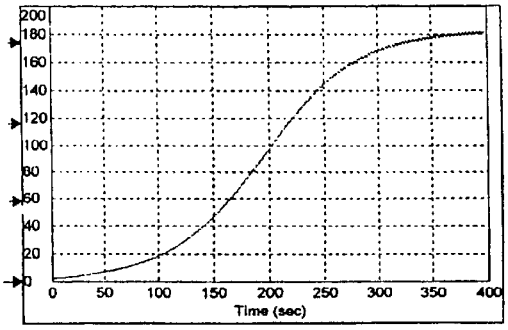
Figure 11:
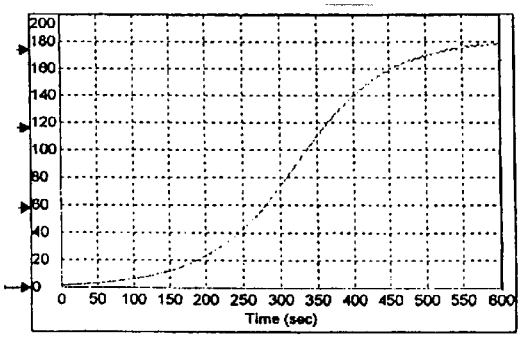

In the description that follows below, the term "ring" will be used to express the same meaning as the term "hollow annular body," although the alternative use of any of such two terms shall not affect the full understandability of the description, due to the context in which such terms are actually used, as anyone skilled in the art will readily appreciate.

Dynamic balancing systems are known to be based on the circumstance that at typical high spin-extraction speeds, which are higher than the resonance frequency of the suspended wash tub assembly, the balancing masses tend to spontaneously move to a position which is exactly opposite to the position where the unbalance of the washload is located, so that they almost immediately turn into automatic balancing elements.

Such a process is generally known in all of its most important practical and theoretical aspects and is based on the fact that the remarkable extent of dynamic unbalance that is brought about by the unbalanced washload during spin-extraction is such as to impart forces of such a direction and an amplitude to the balancing masses as to enable the same balancing masses to move and arrange themselves in the opposite position with respect to the unbalanced washload.

It has been found, and is the basis of the present invention, that even at low rotation speeds of the drum with an unbalanced washload already sticking to the cylindrical wall of the drum, the balancing masses tend, under suitable conditions, to move and arrange themselves into a position which is opposite to the position of the center of gravity of the unbalanced load, with respect of course to the axis of the drum.

In practice, under particular conditions that will be explained in greater detail further on in this description, the same self-balancing process takes place as occurs at the higher spin-extraction speeds. Such a process, which may not be readily appreciated initially since it is apparently contradicting the laws of physics, has been thoroughly investigated from both an experimental and theoretical point of view.

In order to better explain the contents of the invention, all considerations, evaluations, mathematical models and their related processings, experiments, results and interpretations thereof will be described in the following substantially in the form of logical connection between cause, effect and final purport, so that those skilled in the art will find no difficulties at all in understanding the characteristics and the conditions of the invention, as well as the scope thereof.

The invention is substantially based on the same configuration as the one adopted for the dynamic balancing action at the high spin-extraction speed, ie. consisting of one or more annular cavities that are joined together with the drum and arranged so that the related axes coincide, said annular cavities containing respective pluralities of balancing masses of any kind known in the art, such as for instance small disks, cylinders or spheres.

It has initially been found experimentally that there are three different behavior patterns of said balancing masses when the drum rotates at low speed. Such different behavior patterns lead to respectively differing results in terms of positioning and, therefore, self-balancing action.

These behavior patterns will be illustrated first qualitatively and then through mathematical models in a quantitative form.

A) QUALITATIVE DESCRIPTION OF THE INVENTION

Referring to FIG. 1, the washer includes a perforated drum 3 rotatably disposed in a tub 10. A motor 12 rotates the drum 3 at various speeds. These components define a washing assembly disposed in an outer casing 14. Acceleration and frequency sensors 16 detect an unbalance condition of the washload and determine drum rotation frequency. The drum is provided with annular hollow bodies 2 having a preferably rectangular cross-section. One or more balancing masses 1 or disks are movably disposed in each hollow body 2.

In all circumstances, the behavior patterns of the balancing masses are based on the fact that the latter are submerged, even only partially, in a fluidized bed medium acting as a lubricant. The masses move in the respective rings under the effect of the viscous force that is imparted to them by the fluidized bed, which is preferably a liquid, such as oil, having the characteristics as described further on.

Such a liquid is in turn caused to flow by the effect of its friction with the inner walls of the rings as the latter rotate with the drum. Therefore, in an indirect manner, the balancing masses are pushed by the rotation of the drum to move to a position which is higher than their minimum-height position with the drum at a standstill.

Such a forced flow of the liquid is of course opposed by the force of gravity, so that it is assumed that the drum rotates at a speed of approx. 100 rpm, which is actually sufficient for the washload to be enabled to adhere against the peripheral walls of the rotating drum.

To facilitate the description, mention will be made of a single balancing mass in the following, although it is fully and readily clear that the results equally apply to a plurality of such masses. More precisely, such results are actually referred to the center of gravity of such masses.

Referring to FIGS. 1 and 2, three situations may occur in practice:

1) If the viscosity of the liquid is very low, the dragging effect exerted on the balancing mass 1 located in the related hollow body 2 integral with the drum 3 is not sufficient to cause the mass to rotate jointly with the drum, so that it will stop at a certain angle "a" with respect to the vertical through the axis of the drum (see FIG. 2).

Since the unbalancing mass does not rotate jointly with the drum, the situation is quite soon reached in which the unbalancing mass and the washload are in opposition, shown in FIG. 2. However, due to the substantial immobility of the position of the balancing mass, the moment at which said alignment in opposition takes place is almost immediately surpassed by the movement of the washload, so that no sufficient time is left for the drum to be started to rotate at high spin-extraction speed.

In the course of in-depth experiments carried out in order to thoroughly investigate the influence of the individual factors (rotation speed, viscosity and the like) it has been found that, all other conditions being equal, the higher the viscosity of the liquid, the greater the angle "a" to which the balancing mass is dragged.

In the case that the viscosity of the liquid is just below the value needed by the mass to move beyond an angle a=90°, it has been found experimentally that it would take just a small increase in the speed of rotation of the drum to impart to the mass the thrust needed to move beyond a=90°.

This additional acceleration can be either imposed on the driving motor through the speed control arrangement at each revolution of the drum or is generated in a natural manner by the unbalancing washload 4 which drags or pushes the drum downwards while clumped on the left side thereof, as shown in FIG. 2, and therefore tending to go down by the action of gravity, assuming that the drum rotates in the counterclockwise direction.

In both cases the passage of the balancing mass 1 through the angle a=90° is forcedly synchronized with the rotation of the drum, with the washload arranging itself in a position which, with respect to the center of the drum, is opposite to the position of the disk.

The above-described process represents the core of the present invention. It has been found that, due to the effect of an acceleration in the rotational speed of the drum when the washload is in its downward or descending phase and a corresponding deceleration when the washload is in its upward or rising phase, the balancing mass stays in opposition of phase with respect to the washload in a stable manner or at least for a period which is sufficient to impart the desired spin-extraction speed to the drum. That is, the period is sufficient to attain the speed at which there is no longer a need for the mutual position of the two opposing elements to be forced since such a configuration is reached and held automatically, as this is generally well-known from the theory of forced oscillations.

The effect of acceleration and deceleration of the drum can be obtained both naturally as a consequence of the force of gravity acting on the washload which, since it substantially sticks to the inner surface of the drum, conditions the acceleration and, hence, the speed thereof, and by directly forcing the speed of the drum by controlling the drum driving motor accordingly. 2) If, on the contrary, the viscosity of the liquid is very high, the balancing mass is easily dragged upwards, up to the peak of its travel path, after which it "falls" in its downward or descending phase.

Due to the effect of the force of gravity, while said mass rises the movement thereof is delayed with respect to the drum and, while it falls, its movement is on the contrary accelerated.

However, due to the remarkable dragging action brought about by the high viscosity, the condition never occurs in practice in which the balancing mass and the unbalanced washload happen to be aligned in opposition of phase, and this actually prevents the desired self-balancing effect from being obtained even at a low rotational speed.

By providing also in this case for the drum to be imparted accelerations at each revolution thereof, the accelerations and decelerations of the disk tend to compensate each other upon reaching a given angle "a" which depends on the viscosity of the medium (for a given speed of rotation) and the actual manner in which the speed of the drum is varied. The reason behind this stabilization cannot be understood intuitively, but ensues clearly from the mathematical treatment of the phenomenon.

3) There is finally a situation of intermediate viscosity, as this is illustrated by way of example in FIG. 3, so that the viscosity of the liquid is sufficiently high as to drag the balancing mass up to a point beyond a=90°, but not at the first revolution of the drum accelerating from a standstill condition. During the first revolutions of the drum, the mass is accelerated gradually, until its speed is sufficient to surpass a=90°.

As the drum keeps further rotating, said mass moves gradually until it positions itself in opposition to the unbalancing washload and remains in that position for a short period, typically a few seconds, before moving beyond the balancing position.

However, from the teachings given up to this point, those skilled in the art will understand that the selection of the various operating parameters and conditions of the machine in view of being able to balance the drum at low rotating speed can only depend on the general characteristics of the machine, the drum, the hollow bodies, the balancing masses (such as number, arrangement, mass or weight, disposition within the related hollow rings), the dragging medium, as well as all other factors that most affect said balancing effect at low rotating speed of the drum.

It is therefore fully apparent that the present invention can only be applied after an exhaustive series of comparative experiments made on all such factors so as to identify, for each type of machine, the values of said factors which, when appropriately combined, bring about the desired condition of low-speed balancing.

Thanks to the teachings given in this description, such experiments, along with the variables to be compared, are however well within the capability of all those skilled in the art.

B) QUANTITATIVE DESCRIPTION OF THE INVENTION

As this has already been pointed out, the various aforedescribed positioning processes can be explained through the use of a mathematical model, wherein the differential equation of the motion of the drum and a single balancing mass represented by a disk is first established, and the particular cases are then treated individually based on said equation.

It will be appreciated that the model has a limited theoretical validity, since several disks, and not only one of them, will be used in practice. However, the experimental verification made with several disks has demonstrated the validity of the simplified explanation.

B1) Geometric configurations and notes

With reference to FIG. 4, the model refers to a drum rotating at an angular speed $\omega_b$ that varies with time. On the drum there is installed a ring 2 containing a disk 1 having a mass "m" which, submerged in a viscous liquid, rotates at an angular speed $\omega_m$. The friction force $F_a$ between disk and liquid depends on the viscosity of said liquid, as well as shape and dimensions of the cross-section of both ring and disk. The overall effect thereof is summarized into a friction factor $\lambda$.

On the periphery of the drum, there is applied the weight of the unbalancing washload 4, which is kept in position there by the centrifugal force generated by the rotation of the drum 3. Centrifugal forces are not considered in the model since they act perpendicularly on the circumference of the drum and the ring, so that they do not affect the motion.

Both the washload 4 and the disk 1 are exposed to the force of gravity $F_{bg}$, $F_{mg}$, and namely to the component $F_b$, $F_m$ thereof which acts in a tangential direction with respect to the circumferences: $F_b$, $F_m$.

The movement of the drum and that of the disk interact through the viscous liquid which accelerates or brakes both of them, according to their relative speed.

As it can be clearly inferred from FIG. 3, the positions of both the drum (ie. the washload) and the disk are measured starting from the lowest point, on the vertical through the axis of the drum.

B2) The equations of motion

The disk is subject to the following forces:

Force of gravity, in the tangential direction with respect to the ring $$F_{bg}=-m*g$$

and therefore $$F_m=m*g*\sin(\phi_m)$$

where g=gravitational acceleration.

Force of dragging by friction $$F_a=A*(\omega_b-\omega_m)$$

i.e. proportional to the difference in the angular speed of the drum and the disk where $\lambda$ is the coefficient of friction.

These two forces determine a rotation moment about the axis of the drum:

$$L_{mg}=-r*m*g*\sin((\phi_m)$$

$$L_a=r*\lambda*(\omega_b-\omega_m)$$

Similarly, the following equation is derived for the moment generated by the force of gravity acting on the washload:

$$L_{bg}=-r*mb*g*\sin((\phi_b)$$

The torque arm has been considered to be equal to "r" for both the washload and the disk. The motion is caused by the torque $L_{mot}$ of a motor. By summarizing the formulas, the following two equations of motion are obtained for the washload and the disk, respectively:

$$\frac{d\omega_m}{dt}=\frac{L_{mg}+L_a}{m*r^2}$$

$$\frac{d\omega_b}{dt}=\frac{L_{mot}+L_{bg}-L_a}{\theta+m_b*r^2}$$

Figure 16:
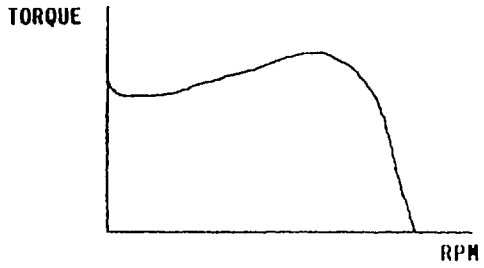
FIGS. 16, 17 and 18 illustrate respective graphs of operational characteristics of the washing machine.

The torque delivered by the motor can be introduced in the model in three manners:

Through the torque/rotation speed characteristic:

$$L_{mot}=L_{mot}(\omega_b)$$

as shown in the graph appearing in FIG. 16.

This method applies to non-controlled motors. By imposing a regulation through the speed control arrangement: a proportional-plus-integral (PI) regulator, as currently used in washing machines, is used in the examples described. The characteristic thereof is:

$$L_{mot}=k1*(\omega_{b0}-\omega_b)+k2*\int_0^t(\omega_{b0}-\omega_b)*dt$$

By imposing a variable speed to the drum. In this case it is assumed that the torque of the motor is sufficiently high as to enable a pre-selected speed profile to be followed:

$$\omega_b=\omega_{b0}*(1+a*\cos((\omega_b))$$

where a=constant.

Figure 17:
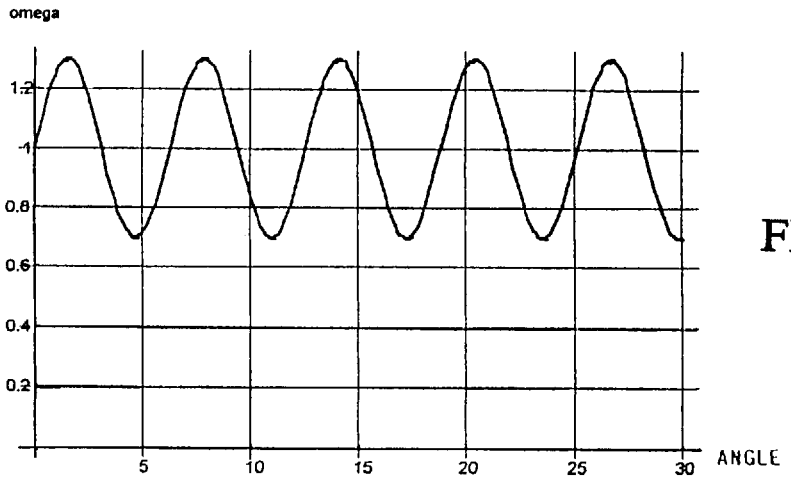

Such a profile is illustrated in FIG. 17.

In this case there is no need for the above differential equation to be used for calculating the speed of the drum, since it is entered as an input in the system. The angle $\phi_b$ can be calculated through the integration of the formula for $\omega_b$:

$$\phi_b=\int_0^t\omega_{b0}*(1+a*\cos(\phi_b))*dt$$

The variable $\phi_b$ appears both in the integrand and on the left side as a dependent variable, so that the integration must be performed by iteration in a numerical manner, starting from $\phi_b=0$.

B3) Application of the mathematical model

Considering that the above-indicated equations of motion cannot be solved in an accurate manner due to the presence of the variables under the "sin," the VISSIM simulation program is used, which contains blocks for the numerical integration.

B4) Imposition of a variable speed to the drum

By combining the above-indicated equations:

$$\frac{d\omega_m}{dt}=\frac{L_{mg}+L_a}{m*r^2}$$

$$\omega_b=\omega_{b0}*(1+a*\cos(\phi_b))$$

and introducing the forced trend of wb in the expression for $L_a$, while also using the formula for $L_{mg}$, the differential equation for the motion of the disk is obtained:

$$\frac{d^2\phi_m}{dt^2}+\frac{\lambda*\omega_{b0}}{m*r}*\frac{d\phi_m}{dt}+\frac{g}{r}*\sin(\phi_m)=\frac{\lambda*\omega_{b0}}{m*r}+a*cos(\phi_b)$$

The equation somewhat resembles the equation for the damped oscillator subject to a periodic force:

$$\frac{d^2x}{dt^2}+2*\delta*\frac{dx}{dt}+D*x=a*\cos(\omega t)$$

with the difference that, in this case, "x" appears in a linear manner and ω is a constant. The damped oscillator is known to assume a motion which shows a phase shift of 180° with respect to the periodic force imparted, if ω is situated beyond the resonance frequency of the system. In a qualitative manner, this result could also explain the reason why the disk in the ring tends to such a phase shift with respect to the oscillating motion of the drum. The equation of motion is solved with numerical methods, whereas the selection of the numerical values for the example considered is as set forth in the table below.

| Parameter | Value | Unit | Meaning |
|---|---|---|---|
| g | 9.81 | $m/s^2$ | Gravitational acceleration |
| r | 0.25 | m | Ring, drum radius |
| $\phi_{m0}$ | 0 | rad | Initial disk position |
| $\phi_{b0}$ | 0 | rad | Initial washload position |
| λ | 10 to 120 | N s/rad | Generic coefficient of friction |
| $\omega_{b0}$ | 10.5 | rad/s | Average drum rotation speed = 100 rpm |
| a | 0.3 | | Factor |

The results are illustrated in the FIGS. 5 to 11. It can be clearly observed how the disk, throughout the range of variation of the coefficient of friction, tends after a certain period to assume a position which is shifted by 180° with respect to the one it was initially occupying in the ring, whereas the greater the friction, the longer the time needed by the disk to reach said position.

In order to more readily understand the manner in which the disk moves with respect to the ring, a short interval of 2 seconds of motion at the beginning and when the disk has reached its "opposing" position is illustrated in FIGS. 12*a* through 12*f*.

It can be observed how in the initial part of the process, when the difference in phase between drum and disk is still small, the speed difference $(\omega_b-\omega_m)$ shows a complex course due to the fact that, when the ring decelerates, also the disk is braked by the force of gravity since it is positioned in the ascending portion of the circumference thereof. Conversely, when the ring accelerates, the disk tends to accelerate even to a greater extent, since it is assisted by the gravity, in the descending portion of the circumference.

In the diagrams relating to the motion in "opposition" it can on the contrary be clearly seen that:

when the ring is slowing down, the disk accelerates, since it is descending;

when the ring is accelerating, the disk is braked, since it is ascending.

Most probably, acceleration and deceleration of the disk compensate each other in such a situation, thereby keeping the phase difference ($\phi_b-\phi_m$) unaltered with respect to the drum. B5) Variable drum speed created by the action of the gravity on the washload: Application of a proportional-plus-integral (PI) control In the case considered above, the variable motion of the drum was forced by the motor speed control. The case in which the motor speed control tries to maintain a constant speed through the application of a PI controller will on the contrary be discussed below.

Now, when the washload is ascending in the rotating drum, the gravity slows down the drum. Conversely, when it is descending, the drum is accelerated. The motion that is imparted to the drum therefore resembles the one discussed in the above illustrated case.

However, as compared to the above discussed case there is a significant difference, ie. as the disk moves to reach its position opposite to the washload, ie. moves to a phase shift of 180° with respect thereto, the same disk starts to balance the washload. This practically reduces the amplitude of the speed oscillation imparted to the drum. Or better still, in the case of a perfect equilibrium between disk and washload, the oscillation becomes nil.

Figure 13A:
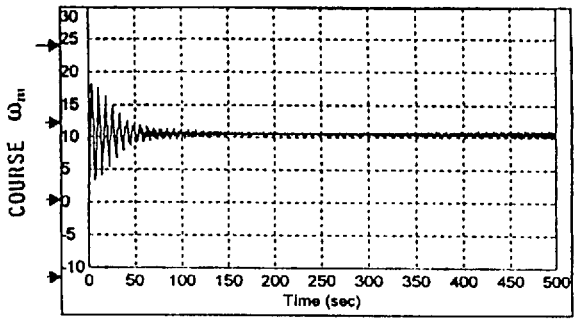
FIGS. 13*a* to 13*c* illustrate the case referred to a unstabilized situation at a phase displacement of 180°.
Figure 13B:
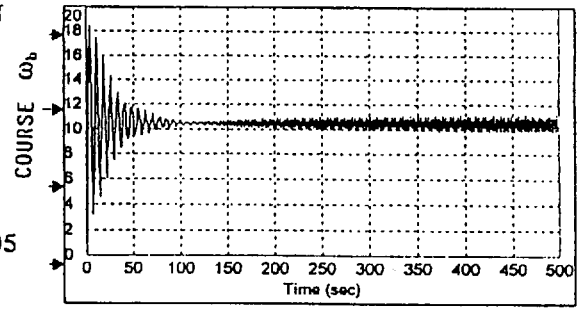
Figure 13C:
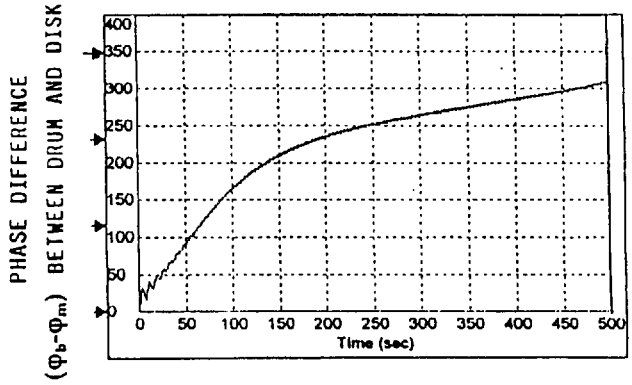

Actually, in the numerical simulations it has been found that such a process does not take place for all combinations of parameters. That is, in some cases, when the 180° phase shift is reached, the same phase shift continues to increase slowly. Therefore, in such particular cases the "opposing" phase shift can be only used for a limited period of time. Both the damping of the angular speeds of the drum and the disk and the continuously increasing phase difference between the same drum and disk, even beyond 180°, can be noticed in FIGS. 13*a* through 13*c*.

Following examples of numerical integration will illustrate the effect of viscosity and rigidity of the control arrangement on the balancing process, whereas the selection of the numerical values for the examples considered is as follows:

| Parameter | Value | Unit | Meaning |
|---|---|---|---|
| g | 9.81 | $m/s^2$ | Gravitational acceleration |
| r | 0.25 | m | Ring, drum radius |
| $\phi_{m0}$ | 0 | rad | Initial disk position |
| $\phi_{b0}$ | 0 | rad | Initial washload position |
| $\lambda$ | 10 to 120 | N s/rad | Generic coefficient of friction |
| k1 | 0.05 to 1 | | Weight for proportional part of motor control |
| k2 | 1 to 120 | | Weight for integral part of motor control |

B6) Effect of viscosity

Figure 14A:
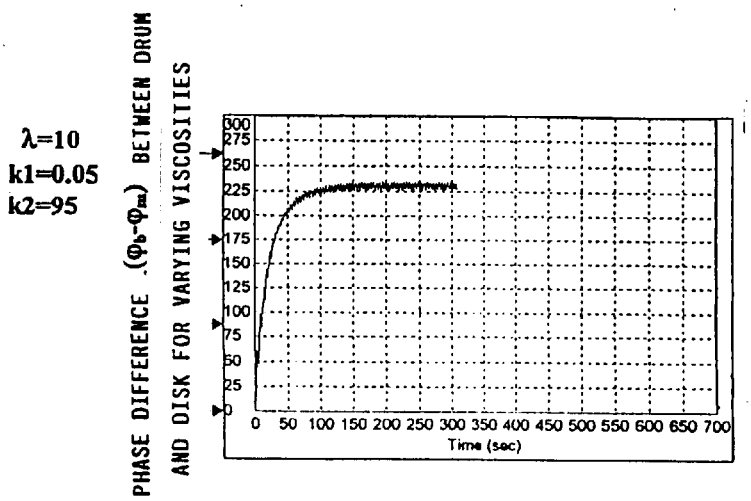
FIGS. 14*a* to 14*c* illustrate the phase displacement between drum and balancing mass at varying viscosity.
Figure 14B:
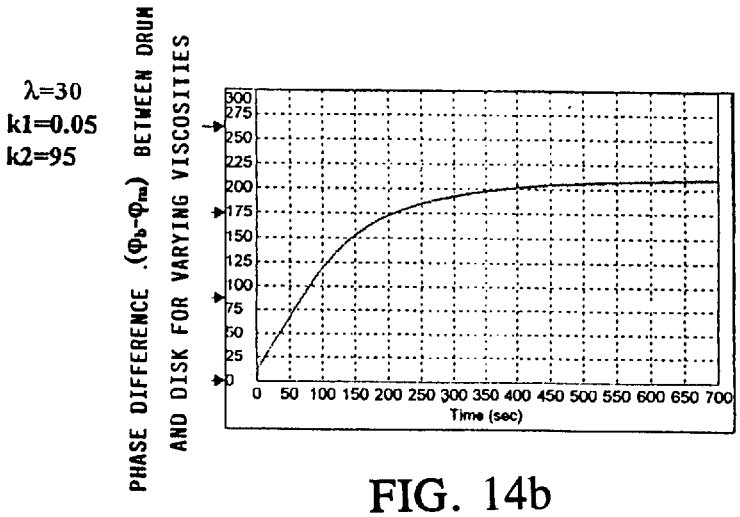
Figure 14C:
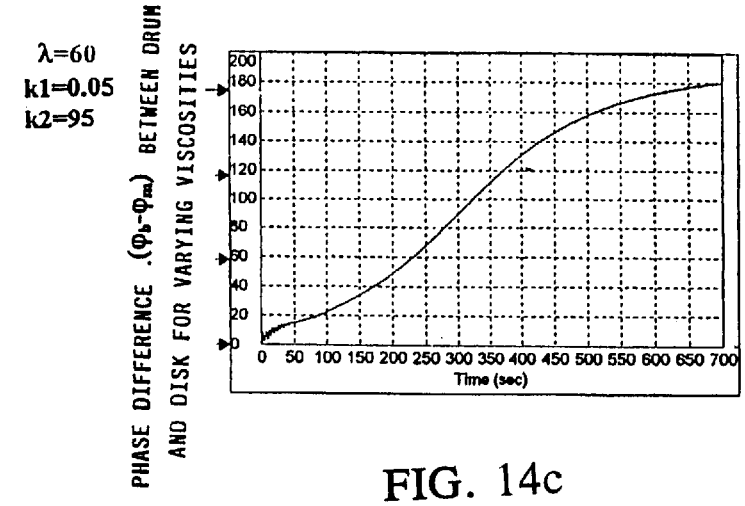

FIGS. 14*a* through 14*c* illustrate for three different viscosities, all other parameters of the motor control system being equal, how the phase shift in the relative motion between drum and disk varies with time, ie. the higher the viscosity, the longer the time required to reach a phase shift of 180°. It can on the other hand be observed how, with low viscosities, said phase shift stabilizes at values greater than 180°.

There is of course a minimum viscosity value, below which the drum is no more able to drag the disk beyond $\phi_m$==90°, so that the disk will remain still at a certain angle with respect to the vertical.

B7) Variable drum speed, created by the action of gravity on the washload: Speed variation resulting from the motor torque-rpm characteristics This method is investigated in view of its possible application in conjunction with a synchronous motors. The motor reacts to motor speed gearing induced by the washload, as this has been described above in the section dealing with the PI control, according to the present characteristics.

Figure 15:
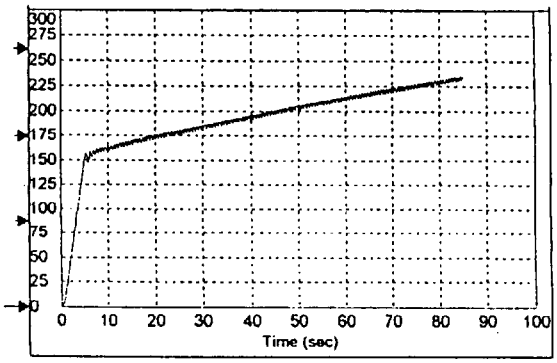
FIG. 15 illustrates the evolution of the phase displacement depending on the initial time.
Figure 18:
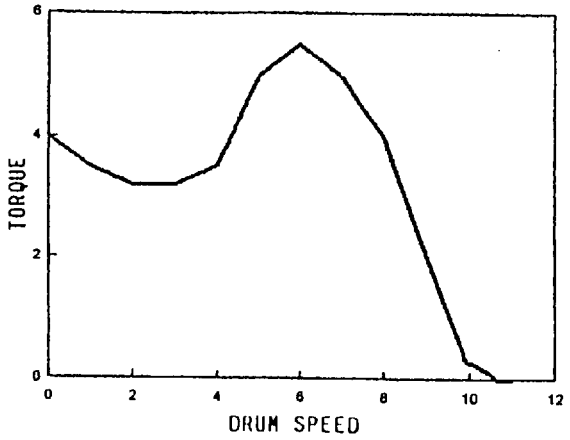

An example is illustrated in FIG. 15 for two viscosity values, wherein the motor characteristic shown in FIG. 18 is used. From the course of the phase difference (($\phi_b-\phi_m$) it can be noticed how, after an interval of adjustment of a few seconds during which the drum is accelerated to a speed of 100 rpm and the disk is not yet able to follow the motion of the drum, the phase starts to vary slowly. Its behavior strongly resembles the one typical of the case with the motor controlled in a proportional manner. In the application of this method it is therefore necessary to wait for ($\phi_b-\phi_m$)=180° before switching over to high spin-extraction speed.

Although the invention has been described on the example of preferred embodiments thereof and using a generally known terminology, it shall not be intended as being limited by these, since it will be appreciated that anyone skilled in the art may be able to use the teachings of this invention to devise any number of variants and modifications thereto. The appended claims shall therefore be intended as to include all such obvious modifications that are readily apparent to those skilled in the art and clearly fall within the scope of the present invention.

What is claimed is:

1. A method of operating a clothes washing machine, provided with an outer casing and a suspended oscillating washing assembly comprising:

a wash tub; a cylindrically shaped perforated drum housed in said tub and capable of rotating in the interior thereof about the axis of the cylinder during washing and spin-extraction; a motor capable of rotatably driving said drum at various speeds;

a dynamic balancing arrangement provided with said drum and formed by a plurality of annular hollow bodies, said bodies forming sealed closed-loop configurations and being mounted integrally with said cylindrical drum with their axes coinciding with the rotational axis of said perforated drum; a liquid of specific viscosity filled in said hollow bodies; and a plurality of moving masses capable of freely moving in said liquid, characterized in that before at least one spin-extraction phase, the drum is driven to rotate in a continuous manner at a variable, relatively low speed in a single direction of rotation, wherein the frequency of said rotation is lower than a frequency of resonance of said oscillating washing assembly, and is sufficient to cause a washload in the drum to stay adhered against an inner peripheral surface of the drum while said moving masses distribute themselves to oppose any unbalanced condition of the washload.

2. A method according to claim 1, characterized in that said liquid maintains its viscosity at a value which stays substantially constant as the temperature of the liquid changes.

3. A method according to claim 1, characterized in that the drum is started to rotate at high spin-extraction speed when the center of gravity of said plurality of moving masses is situated in a substantially opposite position with respect to an unbalancing position of the washload.

4. A method according to claim 3, characterized in that said liquid maintains its viscosity at a value which stays substantially constant as the temperature of the liquid changes.

5. A method according claim 3, characterized in that during the period in which said drum is driven to rotate in a continuous manner at a variable, relatively low speed in a single direction of rotation, the drum is accelerated in a portion of its rotation during which the washload falls down along a descending path, and is slowed down in a portion of its rotation during which said washload rises along an ascending path.

6. A method according to claim 5, characterized in that said liquid maintains its viscosity at a value which stays substantially constant as the temperature of the liquid changes.

7. A method according to claim 1, characterized in that a condition of substantial opposition of the center of gravity of said plurality of balancing masses with respect to the unbalancing washload is detected by processing a signal of a drum rotation frequency sensor.

8. A method according to claim 7, characterized in that said liquid maintains its viscosity at a value which stays substantially constant as the temperature of the liquid changes.

9. A method according to claim 1, characterized in that the condition of substantial opposition of the center of gravity of said plurality of balancing masses with respect to the unbalance of the washload is detected by acceleration sensors associated to said oscillating washing assembly.

10. A method according to claim 9, characterized in that said liquid maintains its viscosity at a value which stays substantially constant as the temperature of the liquid changes.

11. A method of operating a clothes washing machine, provided with an outer casing and a suspended oscillating washing assembly comprising:

a wash tub; a cylindrically shaped perforated drum housed in said tub and capable of rotating in the interior thereof about the axis of the cylinder during washing and spin-extraction; a motor capable of rotatably driving said drum at various speeds;

a dynamic balancing arrangement provided with said drum and formed by a plurality of annular hollow bodies, said bodies forming sealed closed-loop configurations and being mounted integrally with said cylindrical drum with their axes coinciding with the rotational axis of said perforated drum, a liquid of specific viscosity filled in said hollow bodies, and a plurality of moving masses capable of freely moving in said liquid, characterized in that before at least one spin-extraction phase the drum is driven to rotate in a continuous manner and in a single direction of rotation at a relatively low, variable frequency, varied for each revolution of the drum, between a minimum value and a maximum value, wherein said frequency of rotation is sufficient to cause a washload in the drum to stay adhered against the inner peripheral surface of the drum, and the drum is kept rotating in such a continuous manner for a predetermined period while said moving masses distribute themselves to oppose any unbalanced condition of the washload.

12. A method according to claim 9, characterized in that said liquid maintains its viscosity at a value which stays substantially constant as the temperature of the liquid changes.

* * * * *

UNITED STATES PATENT AND TRADEMARK OFFICE

CERTIFICATE OF CORRECTION

PATENT NO. : 5,862,553

DATED : January 26, 1999

INVENTOR(S) : Haberl et al.

It is certified that error appears in the above-indentified patent and that said Letters Patent is hereby corrected as shown below:

Column 7, Line 18, after "accordingly." begin a new paragraph.

Column 8, Line 63, delete "$F_a$=A*($\omega_b$-$\omega_m$)" and insert --$F_a$=A*($\omega_b$-$\omega_m$)--.

Column 9, Line 10, delete "$L_{bg}$=-r*mb*g*sin(($\phi_b$)" and insert --$L_{bg}$=-r*$m_b$*g*sin(($\phi_b$)--.

Column 9, Line 45, delete "$\omega_b$=$\omega_{b0}$*(1+*cos(($\omega_b$))" and insert --$\omega_b$=$\omega_{b0}$*(1+*cos(($\varphi_b$))--.

Column 10, Line 10, delete "wb" and insert --$w_b$--.

Signed and Sealed this

Thirty-first Day of August, 1999

*Attest:*

Q. TODD DICKINSON

*Attesting Officer*

*Acting Commissioner of Patents and Trademarks*